US005917409A

United States Patent [19]

Wang

[11] Patent Number: 5,917,409

[45] Date of Patent: Jun. 29, 1999

[54] PROCESS AND SYSTEM FOR REDUCING MOTION-TYPE FALSE ALARM OF SECURITY ALARM SYSTEM

[76] Inventor: Randall Wang, 5209 N. Tyler Ave., Temple City, Calif. 91780

[21] Appl. No.: 09/145,403

[22] Filed: Sep. 2, 1998

[51] Int. Cl.[6] ..... G08B 29/00

[52] U.S. Cl. ..... 340/506; 340/507; 340/541; 340/565; 340/527; 379/40; 379/44

[58] Field of Search ..... 340/506, 507, 340/511, 527, 528, 541, 565; 379/39, 40, 44

[56] References Cited

U.S. PATENT DOCUMENTS

| | | | |
|---|---|---|---|
| 4,994,787 | 2/1991 | Kratt et al. | 340/505 |
| 5,083,106 | 1/1992 | Kostusiak et al. | 340/506 |
| 5,686,896 | 11/1997 | Bergman | 340/636 |
| 5,801,625 | 9/1998 | Wang | 340/506 |

*Primary Examiner*—Jeffery A. Hofsass
*Assistant Examiner*—Daryl C. Pope
*Attorney, Agent, or Firm*—David and Raymond; Raymond Y. Chan

[57] ABSTRACT

A process for reducing motion-type false alarm of security alarm system includes the steps of merely activating the local warning system to produce local audio and/or video warning signals when any one of the motion sensors detects a motion everytime within the respective motion detecting area; delaying to activate the control panel as well as the phone dialing system which is built in the control panel for a predetermined period of time, wherein the security alarm system is in a verification condition; activating the control panel to normally respond by activating the local warning system and the built-in phone dialing system to transmit digital signals to a central station for dispatching to a designated police resource when at least one more detecting signal is sent from any one of the pre-designated motion sensors that detects another motion within the respective motion detecting area during within the predetermined period of time; and resetting the security alarm system to the original standby condition when there is no other detecting signal sent from any motion sensor within the predetermined period of time.

6 Claims, 3 Drawing Sheets

PROCESS AND SYSTEM FOR REDUCING MOTION-TYPE FALSE ALARM OF SECURITY ALARM SYSTEM

FIELD OF THE PRESENT INVENTION

The present invention relates to security alarm system, and more particular to a process and system for reducing motion-type false alarm of security alarm system for minimizing the possibility of false alarm.

BACKGROUND OF THE PRESENT INVENTION

Security alarm systems are widely used in all kinds of buildings. The common security alarm system adapted to install in office, warehouse, factory, or residence generally comprises a control panel, a local warning system electrically connected to the control panel to provide warning sound, a plurality of window sensors respectively mounted on all glass windows or on the ceiling or walls nearby the windows, which are connected to the control panel and would send a detecting signal to the control panel to trigger the local warning system when the respective glass window is broken, a plurality of door sensors respectively installed at all entrance and exit doors, which are electrically connected to the control panel and would send an activating signal to the control panel to trigger the local warning system when the respective door is unexpectedly opened, a plurality of motion sensors respectively installed at different motion detecting areas (monitoring zones), which are electrically connected to the control panel and would send a motion signal to the control panel to trigger the local warning system when unexpected motion is detected within the respective motion detecting area (monitoring zone), and a key pad for activating and de-activating the burglary alarm system by keying in a preset code.

In order to report the police force that a burglar may be broken into the building when the activated burglary alarm system is triggered, almost every security alarm system further comprises a phone dialing module (communicator/dialer) built in the control panel to connect with the telephone line. Therefore, when any one of the glass sensors, door sensors, and motion sensors sends a corresponding detecting signal to the control panel, the built-in phone dialing module will also be triggered to send digital signals to the central station for dispatching the predetermined police station and alarm company for help and appropriate response. Normally, the police station will immediately send closest policemen to the designated alarming building to investigate and the alarm company will try to contact the owner of the alarming building to inform the owner of the warning situation.

Theoretically, the above arrangement of the burglary alarm system is perfect if there is actually a burglar broken into the building. However, in fact, most of the situations are false alarms caused by the wrongful operation of the security alarm system by the owner. For example, if the user wrongfully sets the alarm but thinking that he or she does it correctly, when any other owner enters the building and keys in the code to de-activate the alarm system, he or she will in fact activate the alarm system, so that his or her later motion will be detected by the motion sensor to falsely trigger the warning system. The security alarm system will also be triggered and cause false alarm if any one of the detecting sensors is out of order. Generally, the motion sensor is a kind of passive infrared detector which is sensitive not only to human beings but also to all kinds of animal such as mouse and flying insect and environmental change of condition. Therefore, if there is a mouse running across a monitoring zone of a motion sensor, the security alarm system will be triggered too.

It is reported that less than 5% of the triggered alarms are caused by actual illegal events. More than 90% of the triggered alarms are false alarms caused by the motion sensors. False alarms are the unsolved troublesome to both the alarm companies and the police resources. Most alarm owners have the unpleasant experience of being waked up in mid-night by the alarm company due to false alarm. Moreover, uncountable waste of time and police force suffers most of the policemen. Before the policemen arrive at the sense, no one knows that whether it is a false alarm or an actual alarm. Therefore, the local police resource charges the alarm owner for a pretty high amount of false alarm operation fee for each false alarm and most of the users have a lot of compliant about that too. It creates a great burden to the limited police force in every city. In fact, millions expense have been wasted for the police resources in responding the false alarms, that greatly degrades the efficiency and performance of the police. Accordingly, some of the police stations in this country consider abandoning such alarm response service. It will only be good news to all burglars. Therefore, how to effectively minimize the possibility of false alarm becomes an urgent topic to both the alarm users and the police resources.

Manual verification seems to be the only solution today, that requires the operators in the central station to manually monitor the information received from the additionally installed audio and video verification equipments. However, such audio and video monitoring equipments are too expensive and will not respond automatically by themselves. Generally, the limited manpower in the central station must monitor many clients at one time, so that man made mistakes are unavoidable.

SUMMARY OF THE PRESENT INVENTION

It is thus a main object of the present invention to provide a process and system for reducing motion-type false alarm of security alarm system, in order to effectively minimize the possibility of false alarm and substantially prevent the waste of police force as well as the unreasonable false alarm operation fee charged by the police to the alarm owner.

A further object of the present invention is to provide a process and system for reducing motion-type false alarm of security alarm system to avoid false alarm, which renders the security alarm system becoming an intelligence system that would automatically verify the first detecting signal sent from any of the motion sensors to the control panel.

Yet another object of the present invention is to provide a process and system for reducing motion-type false alarm of security alarm system to avoid false alarm, wherein no complicate and expensive device is needed to install in the original security alarm system so as to prevent the unreasonable increase of the installation expense of the alarm owner. Moreover, the system is adapted to additionally incorporate with all kinds of currently installed security alarm system, so that the alarm owner does not need to purchase or replace another new set of alarm system.

Still another object of the present invention is to provide a process and system for reducing motion-type false alarm of security alarm system which can avoid false alarm without the manual operation by the central station and the monitoring by the additional video and/or video verification equipments.

In order to accomplish the above objects, the present invention provides a process for reducing motion-type false alarm of a security alarm system, which comprises a control panel, a local warning system electrically connected to the control panel, a plurality of motion sensors which are respectively installed at different motion detecting areas (monitoring zones) and electrically connected to the control panel, a phone dialing system such as a dialer which is built in the control panel for transmitting digital signals to a central station for dispatching a designated police resource when it is activated, comprising the steps of:

1. activating the local warning system to produce local warning signal for a designated period of time, normally two minutes, when any one of the motion sensors detects a motion everytime within the respective motion detecting area;
2. delaying to activate the control panel as well as the built-in phone dialing system for a predetermined period of time, at that moment the security alarm system is in a verification condition;
3. activating the control panel to normally respond by activating the local warning system or any other warning systems and, at the same time, the built-in phone dialing system of the control panel transmits digital signals to the central station for dispatching to the designated police resource when at least one more detecting signal is sent from one of the other predesignated motion sensors (or any one of the motion sensors) that detects a second motion within the respective motion detecting area during the verification condition, i.e. within the predetermined period of time; and
4. resetting the security alarm system to the original standby condition when there is no other detecting signal sent from any motion sensor within the predetermined period of time. In other words, if there is no second motion detected by any motion sensor during the verification condition, the security alarm system will be automatically reset to the standby condition, wherein the standby security alarm system is ready to enter the verification condition again if there is another motion detected by any of the motion sensors again.

Furthermore, in step (1), a detecting signal is sent from the motion sensor which detects the motion to the control panel to activate the local warning system to produce the local warning signal. If the particular detecting signal continues transmitting for a predetermined period of time, generally speaking 30 minutes, the above step (3) will automatically process.

Moreover, the present invention further provides a self-verification system for reducing motion-type false alarm of a security alarm system, which is connected between the motion sensors and the control panel of the security alarm system. The system comprises a central processor unit (CPU), an input circuit connected with the CPU for connecting the motion sensors of the security alarm system with the CPU independently, a PG-selector which is a switch circuit connected with the CPU for setting the CPU for selecting and programming the standby period and functions of the system, a power supply circuit connected with the CPU for purifying power received from the control panel of the security alarm system before sending to the CPU by stabilizing voltage and eliminating interference frequency and noise, a timer/counter generator circuit connected with the CPU for generating counter signals, an output circuit for connecting the CPU with the control panel of the security alarm system, an alarm output connected with the CPU for activating security electrical actions of the security alarm system, and a status controlling circuit connected with the CPU for notifying the self-verification system whether the security alarm system is in arming or disarming status, wherein the status controlling circuit disables the self-verification system when the security alarm system is in disarming status and activate the self-verification system when the security alarm system is in arming status.

DETAILED DESCRIPTION OF THE PREFERRED EMBODIMENT

Figure 1:
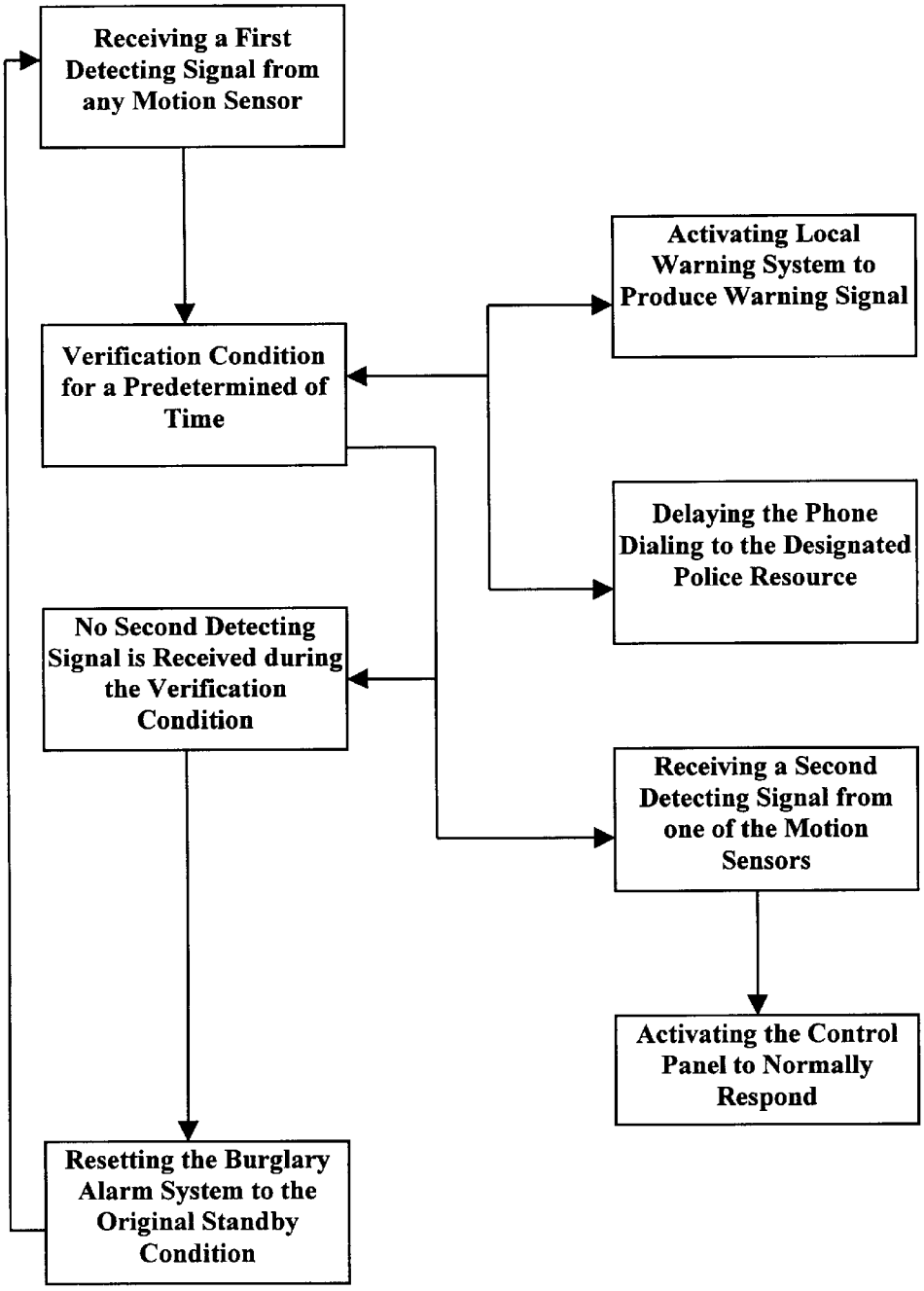
FIG. 1 is a block diagram of a process system for reducing motion-type false alarm of security alarm system according to the present invention.

Referring to FIG. 1, a process for reducing motion-type false alarm of security alarm system according to the present invention is illustrated, which renders the security alarm system becoming a smart system that can automatically avoid false alarm by self-verification without manual operation.

Only a crude and rash person will immediately respond to an unexpected voice heard at home by jumping to the location that he thinks where is the unexpected sound happened or immediately dialing 911 for police support. Since the sound or noise may be simply caused by wind or his or her pet, every normal person will remain still to check for whether there is another unexpected sound within a predetermined period of time before he or she decides to take any responsive action. Practically, it is reasonable to say that the current design of the conventional security alarm system is as stupid as a crude and rash person. That is why the police officers are always suffered by the motion-type false alarms happened every day. The inventive concept of the present invention is to incorporate the intelligence of human thinking for the current security alarm system.

The process for reducing motion-type false alarm of security alarm system of the present invention enables the security alarm system to process self-verification steps before calling the police. The present invention is adapted to all kind of current security alarm system which comprises a control panel, a local warning system electrically connected to the control panel, a plurality of motion sensors which are respectively installed at different motion detecting areas (monitoring zones) and electrically connected to the control panel, a phone dialing system such as a dialer which is built in the control panel for transmitting digital signals to a central station for dispatching to the designated police resource when it is activated.

The process for reducing motion-type false alarm of a security alarm system, which is activated by the alarm user by keying in the security code into an activating and de-activating keypad, comprises the steps as follows.

1. Merely activate the local warning system to produce local warning sound for a designated period of time, normally two minutes, when any one of the motion sensors detects a first motion everytime within the respective motion detecting area.

2. Delay to activate the control panel as well as the built-in phone dialing system for a predetermined period of time, at that moment the security alarm system is in a verification condition.
3. Activate the control panel to normally respond by activating the local warning system or any other warning systems and, at the same time, the built-in phone dialing system to transmit digital signals to the central station for dispatching to the designated police resource when at least one more detecting signal is sent from one of the motion sensors that detects a second motion within the respective motion detecting area during the verification condition, i.e. within the predetermined period of time.
4. However, if there is no other detecting signal sent from any motion sensor within the predetermined period of time, the security alarm system is reset to the original standby condition. In other words, if there is no second motion detected by any motion sensor during the verification condition, the security alarm system will be automatically reset to the standby condition, so that the standby security alarm system is ready to enter the verification condition again if there is another first motion detected by any of the motion sensors again.

Moreover, in the above step (3), it can be preset in such a manner that the control panel will only be activated to normally respond by activating the local warning system or any other warning systems and, at the same time, the built-in phone dialing system of the control panel transmits digital signals to the central station for dispatching to the designated police resource when at least one more detecting signal is sent from another pre-designated motion sensor.

Furthermore, in step (1), a detecting signal is sent from the motion sensor which detects the motion to the control panel to activate the local warning system to produce the local warning signal. If the particular detecting signal continues transmitting for a predetermined period of time, generally speaking 2 minutes, the above step (3) will automatically process.

Figure 2:
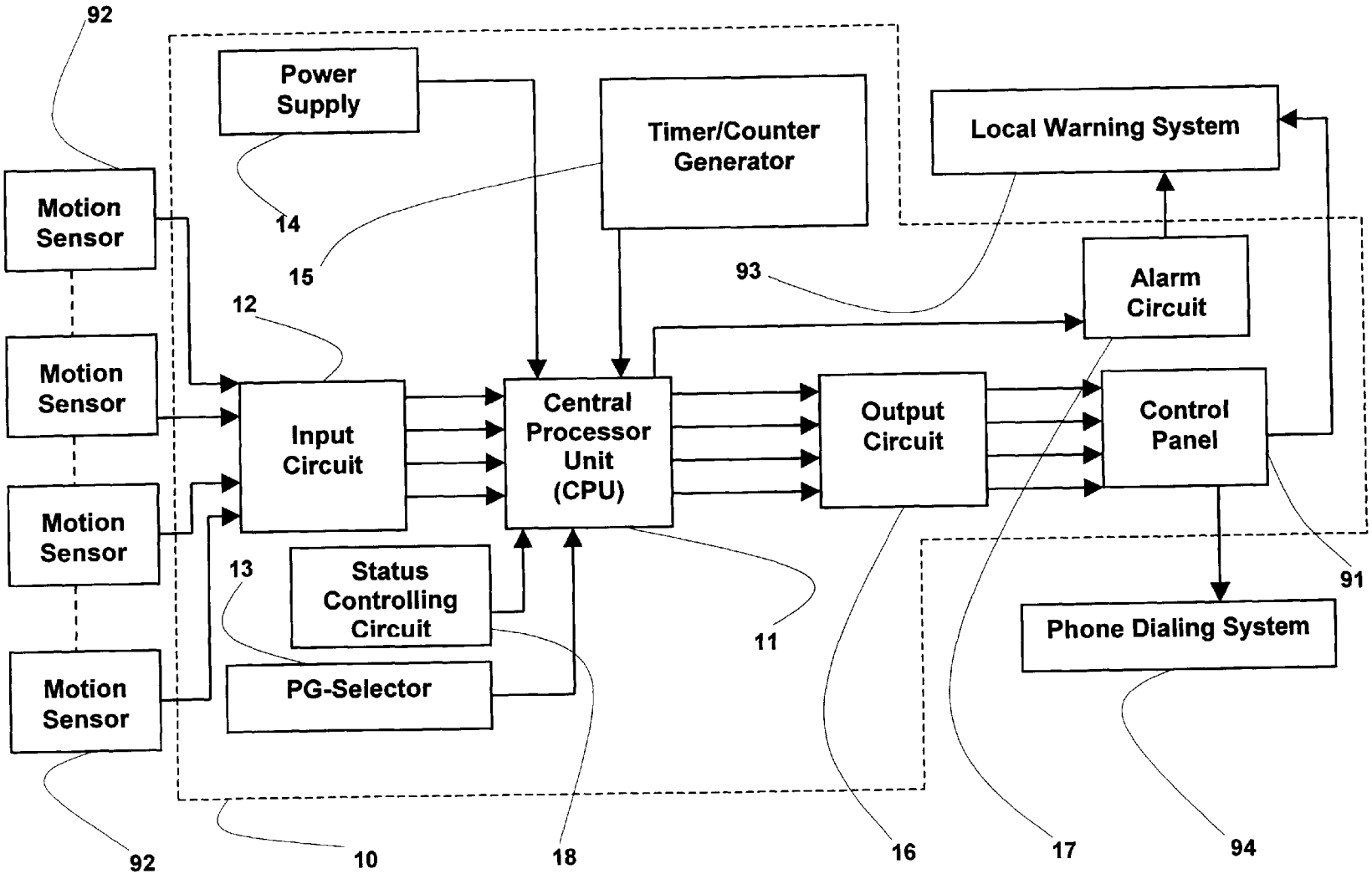
FIG. 2 is a block diagram of a system for reducing motion-type false alarm of security alarm system according to the present invention.
Figure 3:
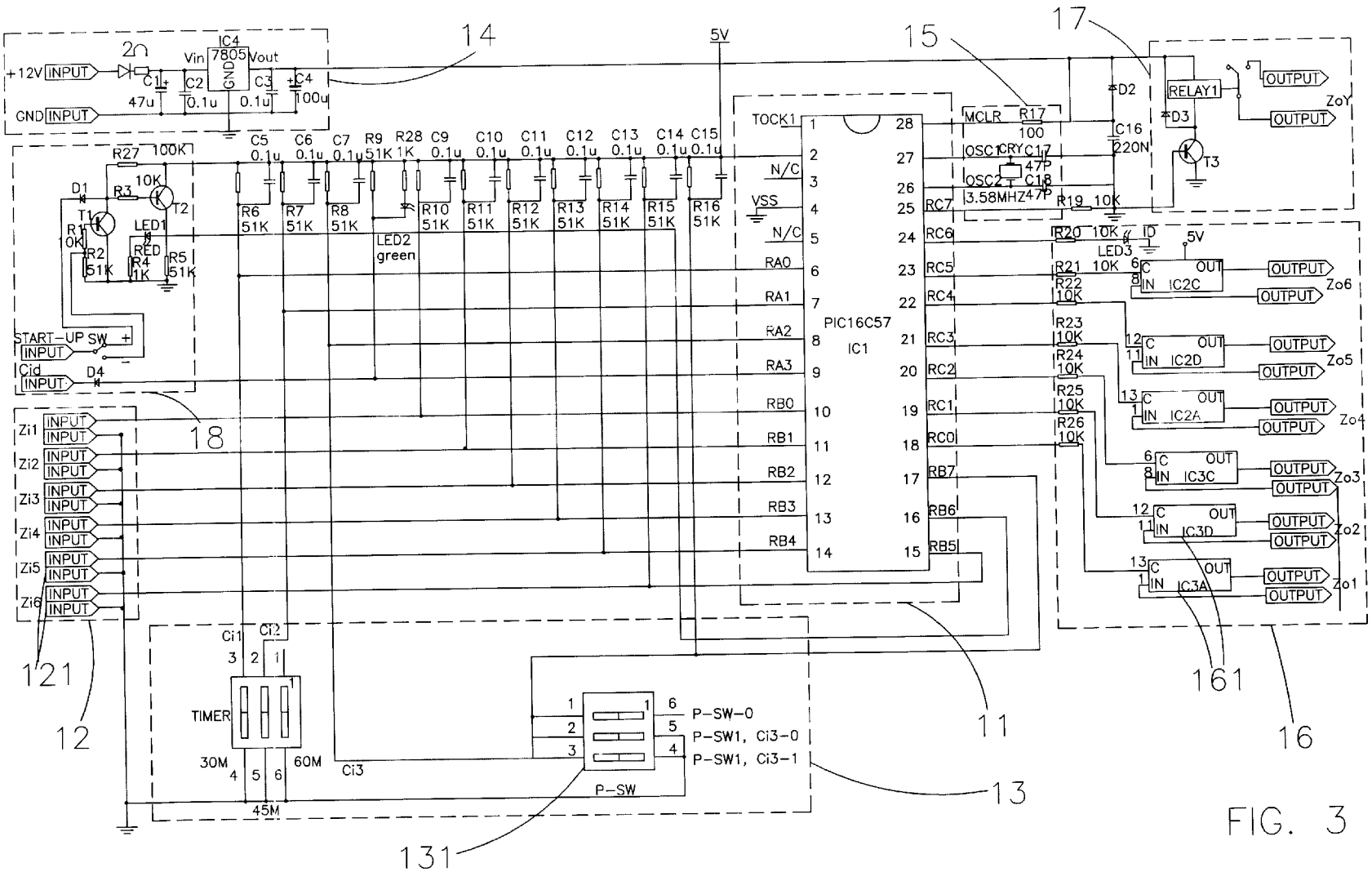
FIG. 3 is a circuit diagram of the system for reducing motion-type false alarm of security alarm system according to a preferred embodiment of the present invention.

Referring to FIGS. 2 and 3, in order to process the above self-verification steps, a self-verification system 10 is connected between the control panel 91 and the motion sensors 92 of the conventional security alarm system. In other words, all the motion sensors 92 are connected to the self-verification system 10 before connecting to the control panel 91, so that all detecting signals sent from the motion sensors 92 will first be detected by the self-verification system 10 which controls whether the detecting signal should be sent to the control panel 91 to trigger the alarm system by activating the local warning system 93 and the phone dialing system 94. Besides, the local warning system 93 is also first connected to the self-verification system 10 before connecting to the control panel 91.

The self-verification system 10 for reducing motion-type false alarm of a security alarm system according to the present invention comprises a central processor unit (CPU) 11 which is a central controller for computation and loading designated software for controlling the following associate circuits, an input circuit 12 which is connected with the CPU 11 having a plurality of input terminals 121 (as shown in FIG. 3) for respectively connecting the motion sensors 92 of the security alarm system with the CPU 11, a PG-selector 13 which comprises a switch circuit 131 connected with the CPU 11 for setting the CPU 11 to select and program the standby period and functions of the system 10, a power supply circuit 14 connected with the CPU 11 for purifying electrical power received from the control panel 91 of the security alarm system before sending to the CPU 11 by stabilizing voltage and eliminating interference frequency and noise, a timer/counter generator circuit 15 connected with the CPU 11 for generating counter signals which are pulse signals for counting a preset standby period of the verification condition, an output circuit 16 having a plurality of output terminals 161 with respect to the motion sensors 92 for connecting the CPU 11 with the control panel 91 of the security alarm system, an alarm output 17 connecting the CPU 11 with the local warning system 93, which generally comprises the audible device and visual device, for activating local security electrical actions of the security alarm system, and a status controlling circuit 18 connected with the CPU for notifying the self-verification system 10 whether the security alarm system is in arming or disarming status, wherein the status controlling circuit 18 disables the self-verification system 10 when the security alarm system is in disarming status and activate the self-verification system 10 when the security alarm system is in arming status.

When any of the motion sensors 93 of the standby security alarm system detects a first motion within the respective monitoring zone, a first detecting signal is sent from the corresponding motion sensor 93 to CPU 11 of the self-verification system 10 via the input circuit 12. The first detecting signal will first enter the self-verification system 10 and activate it to the verification condition. Then, the timer/counter generator circuit 15 will start to generate pulse signals for counting the preset standby period. During the counting standby period, the self-verification system is in the verification condition. At that moment, the CPU 11 of the self-verification system 10 holds the first detecting signal here and only triggers the local warning system 93 to provide audible and/or visual signals through the alarm output 17. In other words, during the verification condition, the first detecting signal will not enter and trigger the control panel 91. The reasons of selectively providing the warning sound are to warn the intruder, if there is actually an intruder broken in, that the security alarm system is triggered, and/or in addition, to warn the user that he or she has wrongfully operated the security alarm system and must immediately reset the security alarm system.

If an intruder enters the building and is detected by any one of the motion sensors 92, the intruder would either search around for larceny or try to escape because of the warning sound produced. Therefore, another motion sensor or even the same motion sensor 92 would certainly detect the intruder's activity within the predetermined standby period of time and send out a second detecting signal to the self-verification system 10. When the self-verification system 10 receives two or more detecting signals from the different motion sensors 92 (or even from the same motion sensor 92 under certain circumstances), the self-verification system 10 would immediately trigger the control panel 91 to normally respond by fully activating the local warning system 93 and any other warning system as well as the built-in phone dialing system 94 to transmit digital signals to a central station for dispatching to the designated police resource. In addition, the number of detecting signals required to be received by the self-verification system 10 during the verification condition before the control panel 91 is triggered and the duration of the predetermined period of time for the verification condition can be preset in the self-verification system by the user according to different situations and environments.

It is worth to mention that the standby period of the verification condition is predetermined by statistics and experimental data. It is recorded that each of the real alarms reported normally has two or more triggers of the motion sensors. However, 95% of the false alarms have only one motion detection by the motion sensors. For the false alarms, even though there are two motion detections, the time between two motion detections will be more than 30 minutes.

According to the statistical and experimental experience, for example, when one motion sensor is installed within a 1000 sq.ft. motion detecting area (monitoring zone), the preferable standby period of the verification condition is 20 minutes. When one motion sensor is installed within a 2000 sq.ft. motion detecting area, the standby period of the verification condition is preferably set at 30 minutes. When two motion sensors are installed within a 1000 sq.ft. motion detecting area, the standby period of the verification condition is preferably set at 10 minutes.

Moreover, the circuitries of the self-verification system 10 can selectively use both the positive and negative continuous voltage, such as 12 VDC and 1 A current, to control the switching on and off of the system 10. Normally, all the input terminals 121 of the input circuit 12 connected with motion sensors 92 are set to "0" condition respectively. When any motion sensor 92 detects motion, the detecting signal sent from that motion sensor 92 will activate the respective input terminal 121 to send out a "1" signal to the CPU 11. Furthermore, if any input terminals 92 sends out a "1" signal more than 2 minutes, the CPU 11 will immediately activate the control panel 91 to normally react by triggering the local warning system 92 and the phone dialing system built in control panel, so that even the intruder cut off the motion sensors from the security alarm system, the continuous detecting signal will be received in the respective input terminal 121 of the input circuit 12 and the self-verification system can also detect and react.

It is worth to mention that since each of the motion sensors 92 is independently connected to the control process unit 11 and then the control panel 93, a "zone by zone" memory function can thus be achieved, wherein all the motion detected by the respective motion sensors 92 are memorized and indicated in the control panel 91 for facilitating the trouble shooting and dispatching of the central station.

Accordingly, the self-verification process and system of the present invention substantially renders the conventional security alarm system to effectively minimize the possibility of false alarm without the need of manual operation, installing additional monitoring video camera and/or replacing the currently installed alarm system with a newly purchased and designed one. It does help to avoid unreasonable waste of the police force and time.

What is claimed is:

1. A process for reducing motion-type false alarm of a security alarm system, which comprises a control panel, a local warning system electrically connected to the control panel, a plurality of motion sensors which are respectively installed at a plurality of motion detecting areas and electrically connected to the control panel, a phone dialing system being built in the control panel for transmitting digital signals to a central station for dispatching to a designated police resource when the phone dialing system is activated, comprising the steps of:

a. merely activating the local warning system to produce local warning signal for a designated period of time when one of the motion sensors detects a motion everytime within the respective motion detecting area during a standby condition of the security alarm system;

b. delaying to activate the control panel as well as the phone dialing system for a predetermined period of time, during which the security alarm system is in a verification condition;

c. activating the control panel to normally respond by activating the local warning system to produce warning signals and the phone dialing system to transmit digital signals to the central station for dispatching to the designated police resource when another detecting signal is sent from one of the other pre-designated motion sensors that detects a second motion within the respective motion detecting area within the predetermined period of time during the verification condition; and d. resetting the security alarm system to the original standby condition when there is no other detecting signal sent from any of the pre-designated motion sensors within the predetermined period of time, wherein the standby security alarm system is ready to enter the verification condition again when there is motion detected by any of the motion sensors again.

2. A process for reducing motion-type false alarm of a security alarm system, as recited in claim 1, wherein in the step (a), a detecting signal is sent from the motion sensor, which detects the motion, to the control panel to activate the local warning system to produce the local warning signal, wherein when the particular detecting signal continues transmitting for a predetermined period of time, the control panel is activated to normally respond by activating the local warning system or any other warning systems and, at the same time, the built-in phone dialing system to transmit digital signals to the central station for dispatching to the designated police resource.

3. A process for reducing motion-type false alarm of a security alarm system, which comprises a control panel, a local warning system electrically connected to the control panel, a plurality of motion sensors which are respectively installed at a plurality of motion detecting areas and electrically connected to the control panel, a phone dialing system being built in the control panel for transmitting digital signals to a central station for dispatching to a designated police resource when the phone dialing system is activated, comprising the steps of:

a. merely activating the local warning system to produce local warning signal for a designated period of time when one of the motion sensors detects a motion everytime within the respective motion detecting area during a standby condition of the security alarm system;

b. delaying to activate the control panel as well as the phone dialing system for a predetermined period of time, during which the security alarm system is in a verification condition;

c. activating the control panel to normally respond by activating the local warning system to produce warning signals and the phone dialing system to transmit digital signals to the central station for dispatching to the designated police resource when at least one more detecting signal is sent from any one of the motion sensors that detects a second motion within the respective motion detecting area within the predetermined period of time during the verification condition; and d. resetting the security alarm system to the original standby condition when there is no other detecting signal sent from any of the pre-designated motion sensors within the predetermined period of time, wherein the standby security alarm system is ready to enter the verification condition again when there is motion detected by any of the motion sensors again.

4. A process for reducing motion-type false alarm of a security alarm system, as recited in claim 1, wherein in the step (a), a detecting signal is sent from the motion sensor, which detects the motion, to the control panel to activate the local warning system to produce the local warning signal, wherein when the particular detecting signal continues transmitting for a predetermined period of time, the control panel is activated to normally respond by activating the local warning system or any other warning systems and, at the same time, the built-in phone dialing system to transmit digital signals to the central station for dispatching to the designated police resource.

5. A self-verification system for reducing motion-type false alarm of a security alarm system which comprises a control panel, a local warning system electrically connected to the control panel, a plurality of motion sensors which are respectively installed at a plurality of motion detecting areas and electrically connected to the control panel independently, a phone dialing system which is built in the control panel for transmitting digital signals to a central station for dispatching to a designated police resource when the phone dialing system is activated, wherein the self-verification system is connected between the control panel and the motion sensors of the security alarm system, the self-verification system comprising:

a central processor unit;

an input circuit which is connected with the central processor unit having a plurality of input terminals for respectively connecting the motion sensors of the security alarm system with the central processor unit;

a PG-selector which comprises a switch circuit connected with the central processor unit for setting the central processor unit to select and program a predetermined standby period and functions for the self-verification system;

a power supply circuit connected with the central processor unit for purifying electrical power received from the control panel of the security alarm system before sending to the central processor unit by stabilizing voltage and eliminating interference frequency and noise;

a timer/counter generator circuit connected with the central processor unit for generating counter signals which are pulse signals for counting the predetermined standby period;

an output circuit having a plurality of output terminals with respect to the motion sensors for connecting the central processor unit with the control panel of the security alarm system; and an alarm output connected the central processor unit with the local warning system of the security alarm system for activating local security electrical actions of the security alarm system;

thereby when one of the motion sensors of the security alarm system detects a first motion within the respective motion detecting area, a first detecting signal is sent from the corresponding motion sensor to the central processor unit via the input circuit, wherein the first detecting signal first activate the self-verification system to a verification condition, and then the timer/counter generator circuit starts to generate pulse signals for counting the predetermined standby period of time, wherein during the counting standby period, the central processor unit holds the first detecting signal here and only triggers the local warning system to provide warning signal through the alarm output, and that when one of the motion sensors detects a second motion within the predetermined standby period of time, a second detecting signal is sent out to the self-verification system, wherein when the self-verification system receives two or more detecting signals from the motion sensors, the self-verification system immediately triggers the control panel to normally respond by fully activating the local warning system and the phone dialing system to transmit digital signals to a central station for dispatching to a designated police resource, moreover when there is no second detecting signal sent from any motion sensor within the predetermined period of time, the security alarm system is reset to the original standby condition, so that the standby security alarm system is ready to enter the verification condition again when there is another first motion detected by any of the motion sensors again.

6. A self-verification system for reducing motion-type false alarm of a security alarm system, as recited in claim 5, further comprising a status controlling circuit connected with the central processor unit for notifying the self-verification system whether the security alarm system is in arming or disarming status, wherein the status controlling circuit disables the self-verification system when the security alarm system is in disarming status and activate the self-verification system when the security alarm system is in arming status.

* * * * *